United States Patent [19]

Olazabal, Jr.

[11] Patent Number: 4,606,544

[45] Date of Patent: Aug. 19, 1986

[54] GAME BALL

[76] Inventor: Frank H. Olazabal, Jr., 2135 Las Colinas Ave., Los Angeles, Calif. 90041

[21] Appl. No.: 706,937

[22] Filed: Feb. 28, 1985

[51] Int. Cl.[4] ..... A63B 41/00

[52] U.S. Cl. ..... 273/65 R; 273/DIG. 20

[58] Field of Search ..... 273/65 EB, 65 E, 65 EC, 273/65 ED, 65 R, 65 A, 65 B, 58 B, 58 BA, DIG. 20, 411, 1.5 A

[56] References Cited

U.S. PATENT DOCUMENTS

| | | | |
|---|---|---|---|
| 2,305,409 | 12/1942 | Crowley | 273/65 EB |
| 2,789,821 | 4/1957 | Crowley | 273/65 EB |
| 4,093,219 | 6/1978 | Pirand | 273/65 B |
| 4,169,594 | 10/1979 | Crane | 273/58 BA |
| 4,333,648 | 6/1982 | Aoyama | 273/65 EB |

FOREIGN PATENT DOCUMENTS

| | | | |
|---|---|---|---|
| 496011 | 9/1953 | Canada | 273/65 EB |
| 500777 | 3/1954 | Canada | 273/65 EB |

OTHER PUBLICATIONS

"Spalding" Catalogue, Fall & Winter, 1953–1954.

*Primary Examiner*—George J. Marlo
*Attorney, Agent, or Firm*—Norman B. Rainer

[57] ABSTRACT

An inflated spherical playing ball having a diameter of 13 to 14 inches is provided for outdoor use and specially adapted for use in a game wherein the ball is kicked by players wearing ice or roller skates. By virtue of the critically selected diameter of the ball, it will travel when kicked in a trajectory having an initial angle of 5° to 45° above horizontal. By virtue of specialized inner and outer fiber windings and their particular bonded relationship to a scuff-resistant cover layer, the ball has sufficient strength to endure the rigors of repeated forceful impact under wet conditions. The cover layer includes a multitude of sections having equilateral pentagonal and hexagonal perimeters and the combined thickness of the bladder, windings and cover is between 5/32 and 7/32 inch. The ball weighs between 24 and 30 ounces.

4 Claims, 3 Drawing Figures

GAME BALL

BACKGROUND OF THE INVENTION

This invention relates to inflatable athletic balls and more particularly to spherical balls of relatively large diameter for outdoor use.

Inflatable playing balls in general use for sports use are generally comprised of (a) a bladder, generally of thin rubber, whose function is to ensure airtightness, (b) a body adhered to the bladder and comprised of fibrous material whose function is to ensure permanence of shape, to maintain dimensions under the inflation pressure, and to ensure the resilient properties necessary for satisfactory rebound, and (c) a wear layer or cover, which may be fabricated of an elastomeric material or leather, secured upon the body.

Large diameter inflatable playing balls have been developed for specialized games such as basketball, volleyball, soccer, and water polo. Large diameter, heavy, filled balls have also been in widespread use as "medicine balls" utilized for exercise purposes. In each of such specialized applications, the exact diameter of the ball and its surface characteristics are of critical significance.

It is an object of the present invention to provide an inflatable ball than can be utilized in sports requiring a large diameter ball.

It is another object of this invention to provide a ball as in the foregoing object of rugged, water-resistant characteristics.

It is a further object of the present invention to provide a ball of the aforesaid nature specifically adapted for use in soccer-like games wherein the players wear ice or roller skates.

These objects and other objects and advantages of the invention will be apparent from the following description.

SUMMARY OF THE INVENTION

The above and other beneficial objects and advantages are accomplished in accordance with the present invention by an inflatable spherical playing ball comprised of:

(a) an internally disposed rubber bladder adapted to be inflated to a spherical shape, and having an air intake valve, (b) a first or inner winding comprised of two layers of intertwisted nylon fiber cords arranged seven cords per inch, the cords of one layer crossing the cords of the other at an angle between about 70° and 90°, said cords being wound in great circles from one continuous length and adhered to the outer surface of the inflated bladder, (c) a second or outer winding contiguous to said first winding and comprised of two layers of nylon strands having little twist arranged 14 strands per inch, the strands of one layer crossing the cords of the other layer at an angle between about 70° and 90°, (d) a cover layer having an inwardly directed boundary in bonded contact with said outer winding, and an outwardly directed boundary comprised of a multitude of sections of equilateral pentagonal and hexagonal perimeters and having a scuff-resistance pebbled surface configuration, (e) the diameter of said ball, measured between diametrically opposed outwardly directed boundary surfaces being between 13 and 14 inches, (f) said bladder, first and second windings and cover layer constituting a wall having a thickness between 5/32 and 7/32 inch, and (g) the weight of said ball being between 24 and 30 ounces.

By virtue of the specially chosen diameter and weight of the ball, it has been found that, when kicked in a manner such that the impact point is about 3½ inches above the playing surface, as is the case when the player is wearing a roller or ice skate, the ball may be propelled in a direction angled upwardly between about 5° and 45° with respect to the playing surface. Balls of smaller diameter would under similar circumstances be propelled horizontally upon the playing surface, and balls of larger diameter would take a more highly angled trajectory, causing difficulty in accurately advancing the ball forwardly in the course of play. The relatively high weight of the ball produces a predictably stable trajectory when airborne in a breeze of wind.

The combined first and second windings provide the strength and durability to survive the highly deforming impacts of repeated forceful kicking.

The pebbled outer boundary surface enables the ball to be used on course surfaces such as concrete without scuffing damage.

The critically chosen diameter of the ball has further significance insofar as it is larger than a standard basketball, yet smaller than the standard 18-inch diameter of a basketball hoop. Accordingly, it is useful in practicing the art of throwing a ball through a basketball hoop because such feat is more difficult to achieve with the ball of the present invention than with a standard basketball.

Because of its heavier than usual weight, the ball of this invention may be used to improve player strength in soccer and volleyball.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate coresponding parts in all the figures of the drawing.

DESCRIPTION OF THE PREFERRED EMBODIMENT

Figure 1:
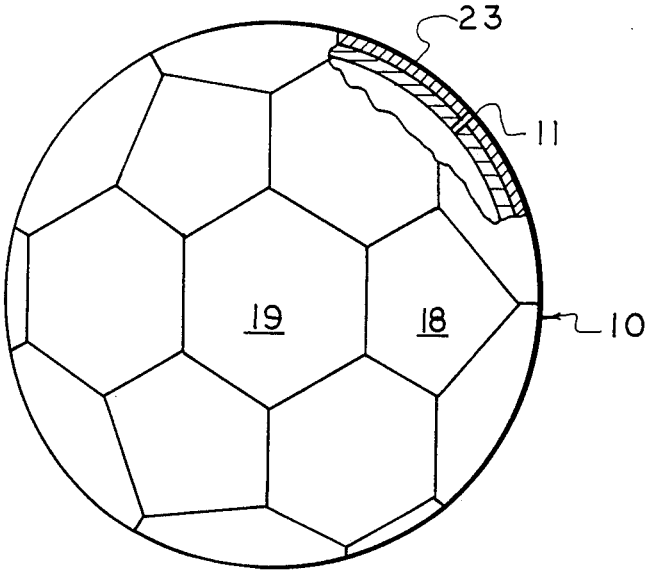
FIG. 1 is a side view of an embodiment of the playing ball of the present invention.
Figure 2:
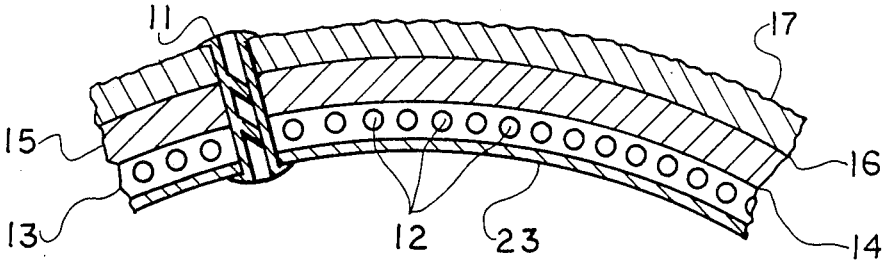
FIG. 2 is a fragmentary sectional view of the wall structure of an embodiment of the playing ball of this invention.

Referring to the drawing, a ball 10 of the present invention is fabricated starting by inflating to a spherical form a bladder 23 of rubber provided with an air intake valve 11 into which an inflating needle can be introduced and which extends through the ball wall so as to be accessible at the interior. The bladder has a relatively thin wall, and may be made by accurately cutting a number of quadrants and seaming them together in the manner described in U.S. Pat. No. 2,218,919. By proceeding in this manner it is possible to make the bladder accurately spherical. The bladder is vulcanized or partly vulcanized in a preliminary step, and the valve is positioned therein.

Upon inflation of the bladder to such an extent that a rather firm sphere of the proper size is provided, a bonding agent is applied thereto, and intertwisted fiber cords 12 comprising the first winding 13 are applied, the turns of which are disposed approximately in great circles about the spherical bladder. Then a layer of unvulcanized rubber 14 is applied over said first winding. The term "rubber" is used in a broad sense so as to include rubberlike material as well as natural and synthetic rubbers and curable resilient synthetic polymeric substances.

The first winding may be applied by placing the bladder in a suitable winding machine, which winds on a length of cord substantially on great circles so as to form a strain-resisting layer of cords. The layer of cords is relatively open so as to provide a multitude of open places or interstices between the cord portions.

A second winding 15 is then applied to rubber layer 14, said winding being comprised of nylon strands 16 applied in substantially great circles.

A cover layer 17 comprised of curable rubber or synthetic polymeric material is applied to the second winding, and the overall assembly is placed in a mold and thermally cured, said mold having a surface which imparts to the outer surface of the cover layer a pebbled configuration and a patterned design of alternating equilateral pentigons 18 and hexagons 19. As a consequence of the aforesaid manner of construction, the ball is impervious to water, and is resistant to impact damage and scuffing injury. The number and size of the pentagons and hexagons may be varied.

Figure 3:
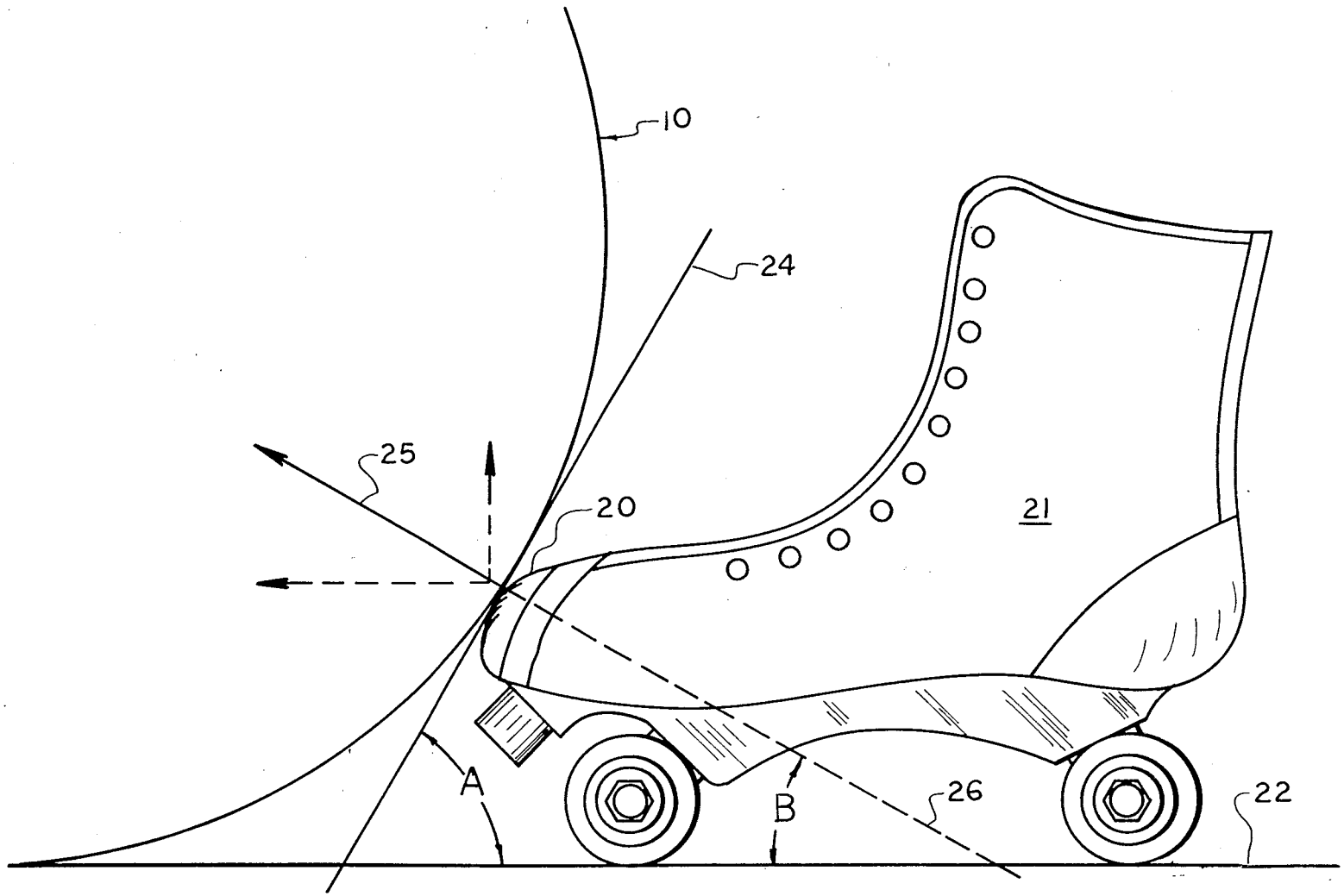
FIG. 3 is an enlarged fragmentary side view of the ball showing the critical significance of the diameter of the ball.

FIG. 3 indicates the critical significance of the outer diameter of the ball. The impact site 20 at which kicking is achieved by a player wearing a roller skate shoe 21 is about 3½ inches above horizontal playing surface 22. The tangent line 24 at impact site 20 drawn in a vertical plane is seen to intersect playing surface 22 to form therewith acute angle A. The direction of force applied to the ball may be represented by force line 25 perpendicularly disposed to said tangent line. When force line 25 is extended to intersection with playing surface 22, as shown by dotted line 26, acute angle B is defined. Said angle B represents the approximate trajectory path of which the ball will be propelled when kicked. For the purposes of playing soccer on skates, it is necessary that angle B be between 5° and 45°. In order to achieve such values of angle B when the impact site is 3½ inches above the playing surface, the diameter of the ball must be between 13 and 14 inches.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An inflatable spherical playing ball comprised of:
   (a) an internally disposed rubber bladder adapted to be inflated to a spherical shape, and having an air intake valve,
   (b) a first or inner winding comprised of two layers of intertwisted nylon fiber cords arranged about seven cords per inch, the cords of one layer crossing the cords of the other layer at an angle between about 70° and 90°, said cords wound in great circles from one continuous length and adhered to the outer surface of the inflated bladder,
   (c) a second or outer winding continguous to said first winding and comprised of two layers of nylon strands having little twist arranged about 14 strands per inch, the strands of one layer crossing the cords of the other layer at an angle between about 70° and 90°,
   (d) a cover layer having an inwardly directed boundary in bonded contact with said outer winding, and an outwardly directed boundary comprised of a multitude of sections of equilateral pentagonal and hexagonal perimeters and having a scuff-resistance pebbled surface configuration,
   (e) the diameter of said ball, measured between diametrically opposed outwardly directed boundary surfaces being between 13 and 14 inches,
   (f) said bladder, first and second windings and cover layer constituting a wall having a thickness between 5/32 and 7/32 inches, and
   (g) the weight of said ball being between 24 and 30 ounces.

2. The playing ball of claim 1 adapted to be kicked by the toe of a roller skate in a manner such that the ball will take a trajectory path having a starting angle of between 5° and 45°.

3. The playing ball of claim 2 wherein the outwardly directed boundary of the cover layer is impervious to water.

4. The playing ball of claim 3 wherein said cover layer is comprised of a material selected from the group consisting of curable rubber and synthetic polymeric material.

* * * * *